US008975496B2

(12) United States Patent
Meeks et al.

(10) Patent No.: US 8,975,496 B2
(45) Date of Patent: Mar. 10, 2015

(54) PORTABLE BELL SYSTEM

(75) Inventors: William Meeks, Georgetown, OH (US); Richard Watson, Georgetown, OH (US)

(73) Assignee: Bellebrations IP Holdings, LLC., Tampa, FL (US)

( * ) Notice: Subject to any disclaimer, the term of this patent is extended or adjusted under 35 U.S.C. 154(b) by 449 days.

(21) Appl. No.: 13/525,266

(22) Filed: Jun. 15, 2012

(65) Prior Publication Data

US 2012/0318116 A1 Dec. 20, 2012

Related U.S. Application Data

(60) Provisional application No. 61/498,146, filed on Jun. 17, 2011.

(51) Int. Cl.

| | |
|---|---|
| ***G10F 1/08*** | (2006.01) |
| ***G10D 13/08*** | (2006.01) |
| ***G10K 1/26*** | (2006.01) |

(52) U.S. Cl.

CPC ..... *G10D 13/085* (2013.01); *G10K 1/26* (2013.01)

USPC ..... 84/103

(58) Field of Classification Search

USPC ..... 84/402–410, 103

See application file for complete search history.

(56) References Cited

U.S. PATENT DOCUMENTS

| | | | | |
|---|---|---|---|---|
| 3,077,138 | A * | 2/1963 | Vaughn, Jr. et al. | 84/103 |
| 2008/0078278 | A1 * | 4/2008 | Malta | 84/406 |

* cited by examiner

*Primary Examiner* — Kimberly Lockett

(74) *Attorney, Agent, or Firm* — Rabin & Berdo, P.C.

(57) ABSTRACT

A bell unit of a portable bell system, including a support structure, a plurality of bells mounted on the support structure, a bell shell including a plurality of segments, at least one of which is displaceable to allow a size change of the bell unit. The bell shell is configured to be in a first position when the plurality of segments form a shell that is of a shape of a bell, and hangs over and partially encloses the support structure and the plurality of bells, and is in a second position when the at least one segment is displaced to effectuate the size change.

20 Claims, 6 Drawing Sheets

PORTABLE BELL SYSTEM

CROSS-REFERENCE TO RELATED APPLICATION

This application claims the benefit of U.S. Provisional Application No. 61/498,146, filed Jun. 17, 2011.

BACKGROUND (1) Field of the Invention

The present invention relates to a portable bell system. More specifically, it relates to a portable bell system that has a displaceable bell shell for easy storage and transportation.

(2) Background Information

Bell systems having a chime of bells are used in many festival, celebrative and ceremonial occasions. Many such systems are installed in churches, and are fixed in place in bell towers, thus seriously limiting their usage to a few possible venues.

It is desirable to have portable bell systems that may be used in many places. These bell systems will greatly expand the ways in which celebrations may be performed, and are advantageous as compared to conventional bell systems in terms of both convenience and cost. Such bell systems can bring to a celebration, wherever it may be, the same grandeur and majesty of the bell music previously only available at church venues.

A bell system typically has a chime of bells, and it is beneficial to have a bell system that is esthetically pleasing, easy to store and transport, and easy to use.

SUMMARY OF THE INVENTION

A bell unit of a portable bell system may include a support structure, bells mounted on the support structure, a bell shell having a number of segments, at least one of which is displaceable to allow a change in the size of the bell unit. The bell shell is in a first position when the segments form a shell that is of a shape of a bell and hangs over and partially encloses the support structure and the bells, and is in a second position when the at least one segment is displaced to effectuate the size change.

A portable bell system may include a bell trailer and a bell unit mounted on the bell trailer. Such a bell unit may include a support structure configured to be fixed on the bell trailer, bells mounted on the support structure, and a bell shell including a number of segments, at least one of which is displaceable to allow a change in the size of the bell unit. The bell shell is in a first position when the segments form a shell that is of a shape of a bell and hangs over and partially encloses the support structure and the bells, and in a second position when the at least one segment is displaced to effectuate the size change.

A portable bell system may include a computer for controlling the bell system, an interface for converting a control signal from the computer to a DC pulse, a pneumatic power source for bell striking, and a bell unit. Such a bell unit may include a support structure, bells mounted on the support structure, and a bell shell including a number of segments configured to form a shell that is of a shape of a bell, and to hang over and partially enclose the support structure and the plurality of bells, at least one of the shell segments being displaceable to allow a change in the size of the bell unit. Each bell has a clapper for ringing the bell, a pneumatic actuator for activating the clapper, and a control valve that, responsive to the DC pulse, controls pneumatic power passing therethrough from the pneumatic power source, so as to drive the pneumatic actuator to activate the clapper of the bell.

DETAILED DESCRIPTION

The invention will now be described in more detail by way of example with reference to the embodiments shown in the accompanying figures. It should be kept in mind that the following described embodiments are only presented by way of example and should not be construed as limiting the inventive concept to any particular physical configuration. Further, if used and unless otherwise stated, the terms "upper," "lower," "front," "back," "over," "under," and similar such terms are not to be construed as limiting the invention to a particular orientation. Instead, these terms are used only on a relative basis.

Figure 1:
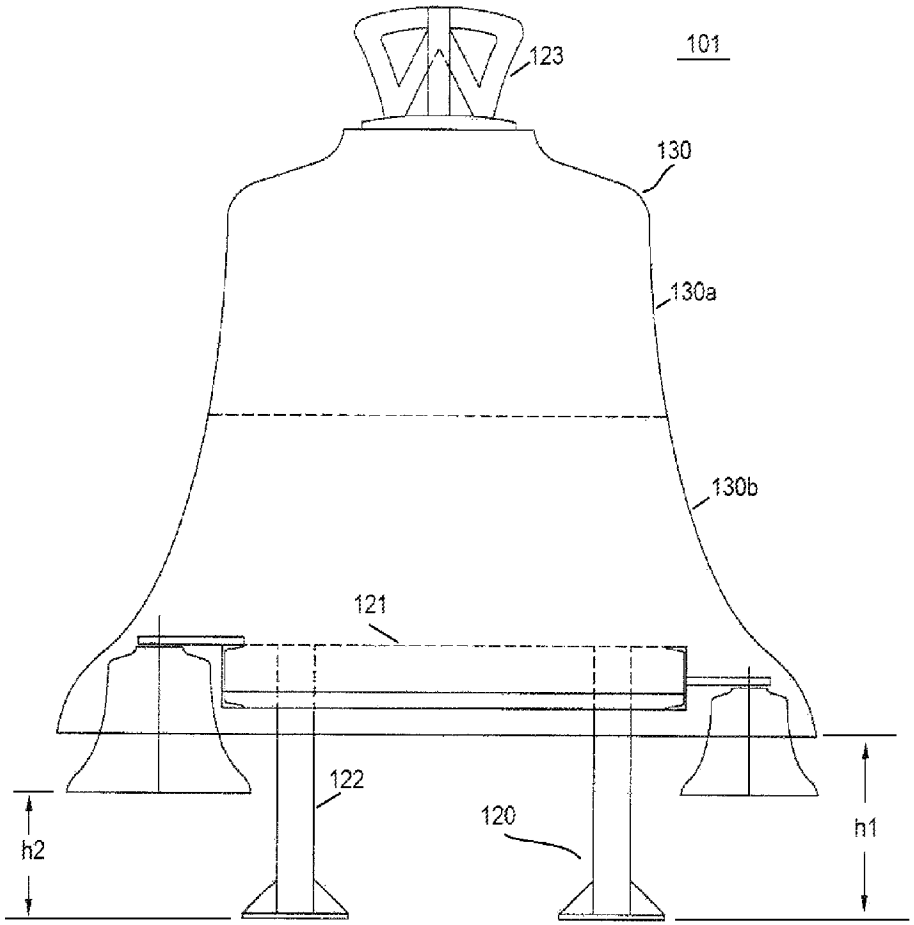
FIG. 1 is an illustration of one embodiment of the invention in which a bell unit of a bell system is set up for performance.
Figure 2:
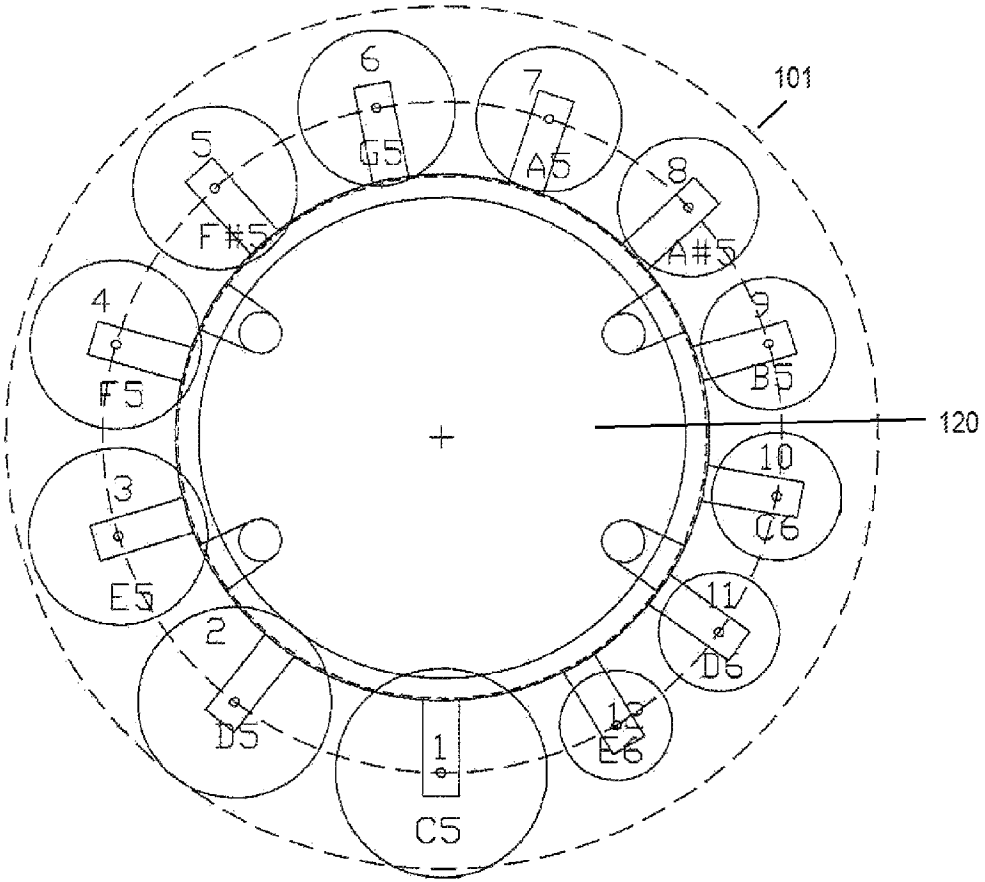
FIG. 2 is a diagram that shows the arrangement of the bells of the embodiment of FIG. 1.

A bell unit in one embodiment of a portable bell system (which is alternatively called a portable chime of bells) is illustrated in FIGS. 1 and 2. FIG. 1 is an illustration of the bell unit set up for a performance. FIG. 2 is a diagram that shows the arrangement of the bells of the bell unit.

Figure 3:
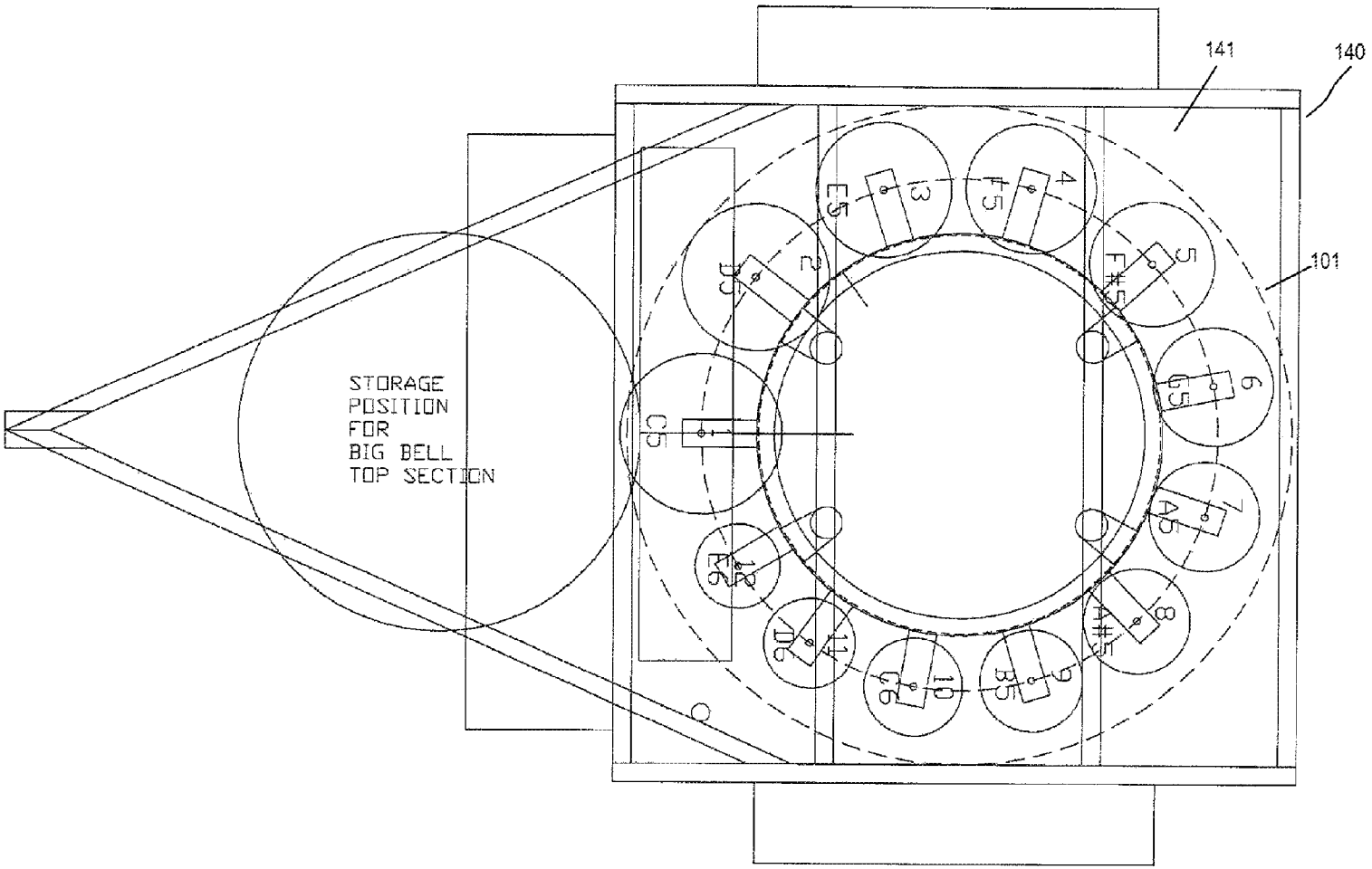
FIG. 3 is a plan view of a bell trailer with a mounted bell unit in one embodiment of the invention.
Figure 4:
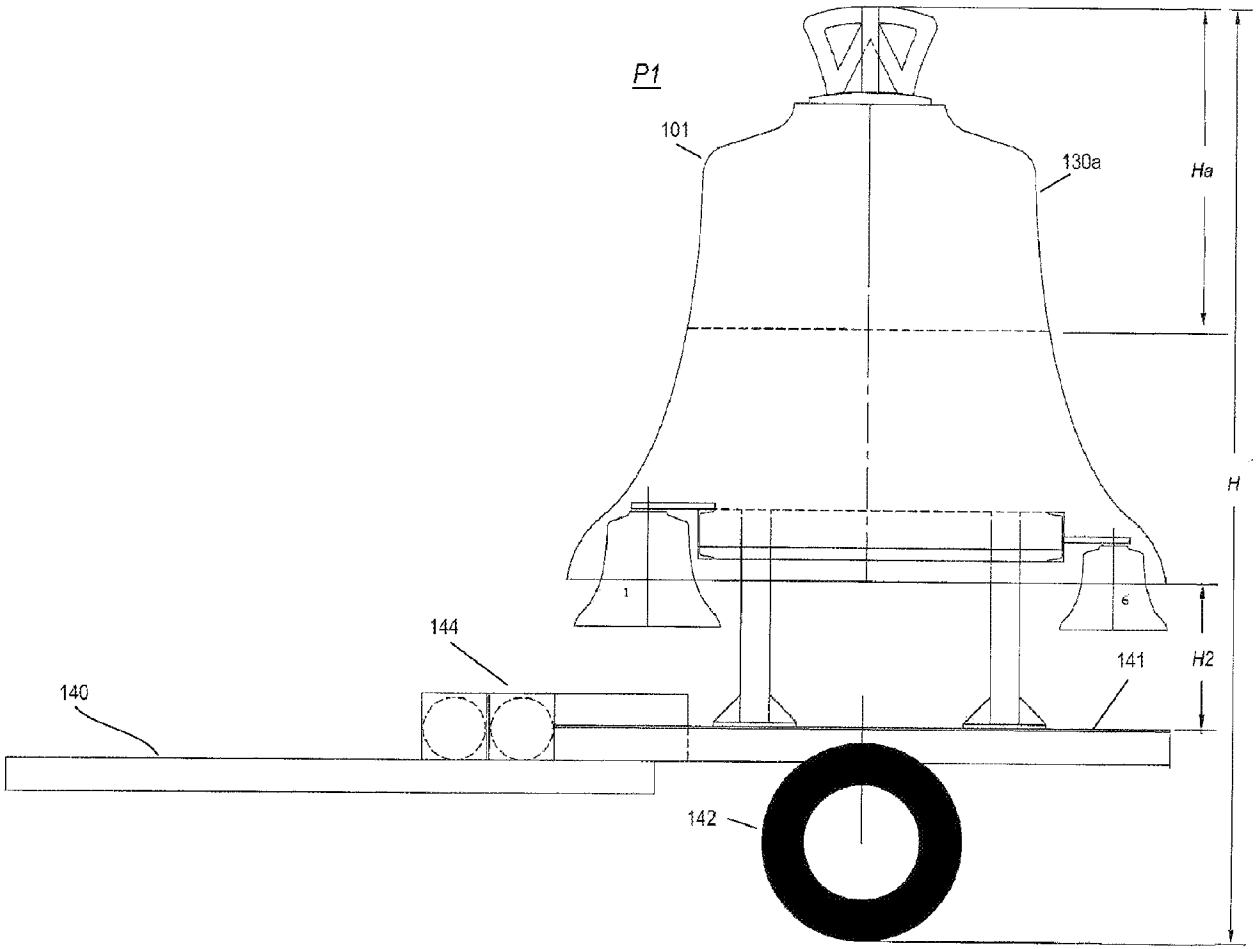
FIG. 4 shows a bell trailer with the bell unit mounted in a first position, with the top of the bell shell in place.

As shown in FIGS. 1 and 2, a bell unit 101 of a portable bell system has a plurality of bells 1-12 (see FIG. 2) that are mounted on a support structure 120. In this embodiment, the support structure 120 is made of a rolled steel plate 121 that is securely attached to a plurality of supports 122. The support 122 may be vertical members attached to a bell trailer 140 (see FIGS. 3-5) provided to carry the chime. Bells 1-12 are isolated from the support structure 120 by Neoprene pads or similar isolation. As may be contemplated by a skilled artisan, other configurations and/or materials may also be used for the support structure 120, as long as the so-formed support structure has enough strength and durability to support the bells.

In this embodiment, the bells 1-12 are hung from the support structure 120 in a circular arrangement, with the lip (or lower rim) of each bell being of a height h1 above a surface on which the supports 122 are placed. As such, since the bells 1-12 have different sizes to produce different sounds, they are mounted to the support structure 120 in a spiral arrangement. The bells 1-12 can be hung with equal spaces between neighboring bells, or in another acoustically-proper manner.

As illustrated in FIG. 2, the bell unit 101 includes twelve bells 1-12, which may be, for example, cast bronze bells or other bells of suitable acoustic characteristics. The bells 1-12 may be made of appropriate materials, weights and diameters so as to produce proper musical notes. In one embodiment of the invention, the bells 1-12 are cast bronze bells that are capable of producing musical notes in accordance with the American Standards Association notation, and are tuned, after casting, based on a five-point principle with A4=440 Hz. The bells 1-12 may have a bright, sanded finish showing the color of bell bronze. In this embodiment, the approximate weights and diameters of the cast bronze bells 1-12 may be as follows:

| No. | Note | Weight | Diameter |
|---|---|---|---|
| 1 | C5 | 140 lbs. | 17½" |
| 2 | D5 | 110 lbs. | 16" |
| 3 | E5 | 92 lbs. | 14¾" |
| 4 | F5 | 84 lbs. | 14⅛" |
| 5 | F#5 | 76 lbs. | 13 9/16" |
| 6 | G5 | 68 lbs. | 13" |
| 7 | A5 | 56 lbs. | 12" |
| 8 | A#5 | 50 lbs. | 11 9/16" |
| 9 | B5 | 44 lbs. | 11⅛" |
| 10 | C6 | 39 lbs. | 10 11/16" |
| 11 | D6 | 34 lbs. | 9 15/16" |
| 12 | E6 | 29 lbs. | 9¼" |

As such, the approximate total weight of the bells is 822 lbs. These bells may be of the standard Meeks, Watson & Company carillon and chime bell design and scaling. Such a configuration of notes may provide a great versatility of use for this range.

As illustrated in FIG. 1, both the bells 1-12 and the support structure 120 are covered by a bell shell 130 that may be in the shape of a big bell. The bell shell 130 may be made of fiberglass or a similar material. In one embodiment of the invention, the bell shell 130 may include a decorative "crown" 123, which may be detachable if desired, for replacement with other appropriate ornaments, as for instance a spire or other symbolic decoration in other embodiments of the invention. The bell shell 130 in the embodiment of FIG. 1 may be of approximately 6 feet in diameter and 6 feet in height including the crown thereof.

The bell shell 130, when in a display position or is set up for a performance, hangs over and partially encloses the bells 1-12 and the support structure 120, with the lip (or lower rim) of the bell shell 130 being of a height h2 above the surface that the supports 122 are placed on. In this embodiment, h1 (e.g. 12 inches) is made smaller than h2 (e.g. 17.625 inches) to achieve the desired acoustic effect. The support structure 120 is also arranged to carry the large bell shell 130.

The bell shell 130 may be formed of a number of segments. For example, the bell shell in the embodiment illustrated in FIG. 1 has separable first and second half shells 130*a* and 130*b*. A separable bell shell 130 facilitates the storage and transportation of the bell system 100, which in various embodiments may be of a large height or a large volume. In the embodiments illustrated in FIGS. 1 and 3-5, the first and second half-shells are respectively top and bottom half shells, although in other embodiments the bell shell 130 may also be properly divided in another fashion. The top half shell 130*a* has a height Ha that is roughly half of that of the bell shell 130, and is designed to be dismountable to permit its mounting elsewhere on the bell trailer 140 (see FIG. 5) for travel, and to limit the height of the unit to allow storage in a standard garage.

The bell unit 101 optionally may be installed on a bell trailer 140. The bell trailer 140, in one embodiment illustrated in FIGS. 3-5, includes a platform 141 and wheels 142 that support the platform 141. The bell unit 101 is installed on the platform 141. A auxiliary support structure 143 is fixed onto the bell trailer 140.

Figure 5:
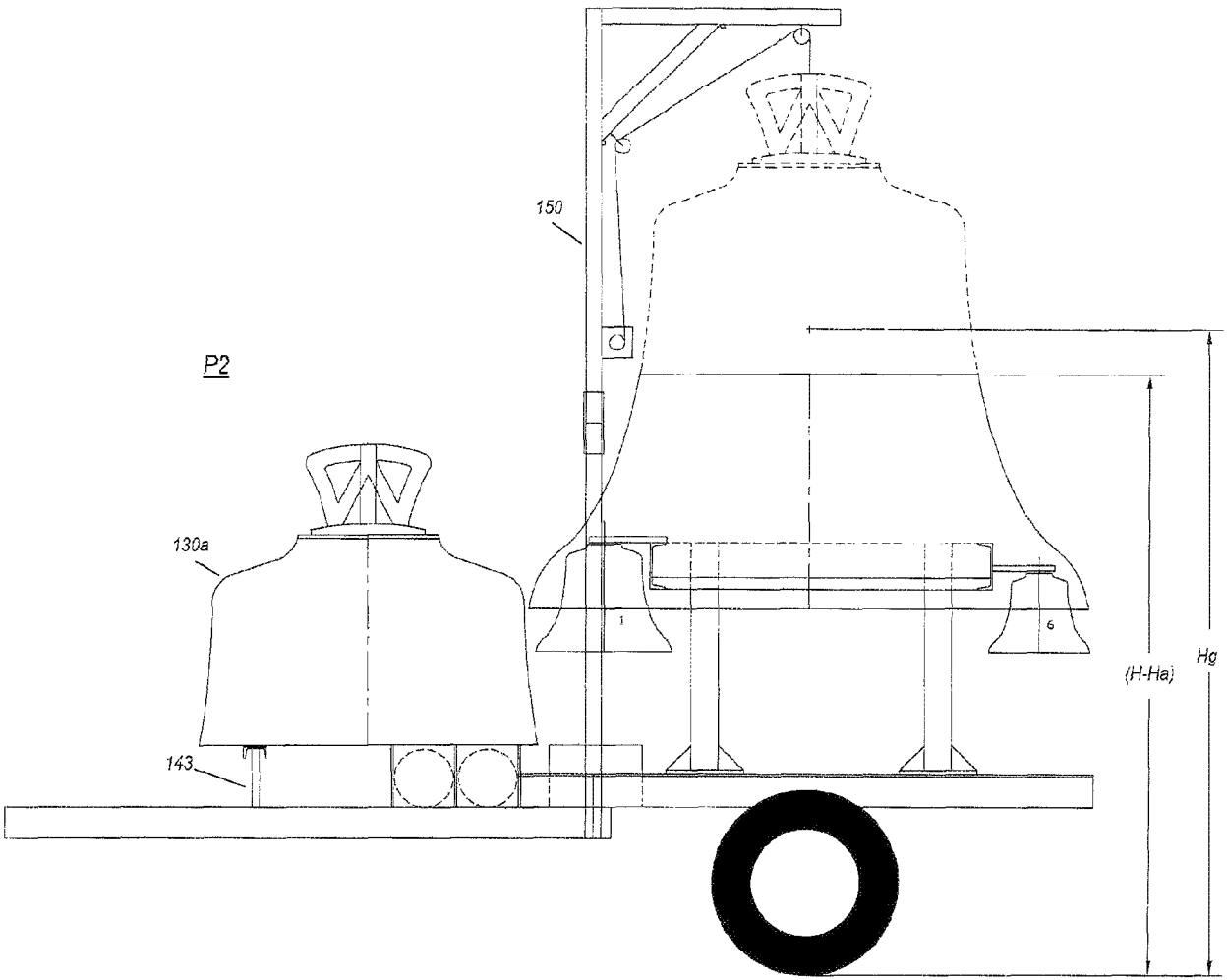
FIG. 5 shows a bell trailer with the bell unit mounted in a second position, with the top of the bell shell removed to permit storage in a standard garage.

For the portable bell unit 101, in a first position P1 (i.e. a display position, for example when the bell unit 101 is set up for a musical performance), the first half shell 130*a* may be coupled to the second half shell 130*b*. In a second position P2, which may be a storage position to facilitate the storage and transportation, the first half shell 130*a* may be separated from the second half-shell 130*b*, and may be mounted on the auxiliary support structure 143. The auxiliary support structure 143 may be securely installed on the platform 141, or at another position of the bell trailer 140 that is not on the platform 141 (as illustrated in FIG. 5). The auxiliary support structure 143 may optionally include storage compartments 144, which may be used to store small objects such as air bottles and skirting.

As such, if the height of the first half shell 130*a* is Ha (e.g. 35.0625 inches), and the portable bell unit 101 when in the first position P1 is of a height H (e.g. 113.25 inches) above the ground, it will be of a height (H-Ha) (i.e. 78.1875 inches) above the ground when in the second position P2. Thus, when the height of the garage door Hg is 84 inches, the portable bell unit 101 installed on the bell trailer 140 may be successfully lead into the garage when it is put in the second position P2 (because 78.1874<84), although it cannot be stored in the garage when in the first position P1 (because 113.25>84).

A hoist, driven by mechanical force, electrical force or otherwise, may optionally be used to displace the first half shell 130*a* when the position of the bell unit 101 is switched from the display position P1 to the storage position P2, or vice versa.

Figure 6:
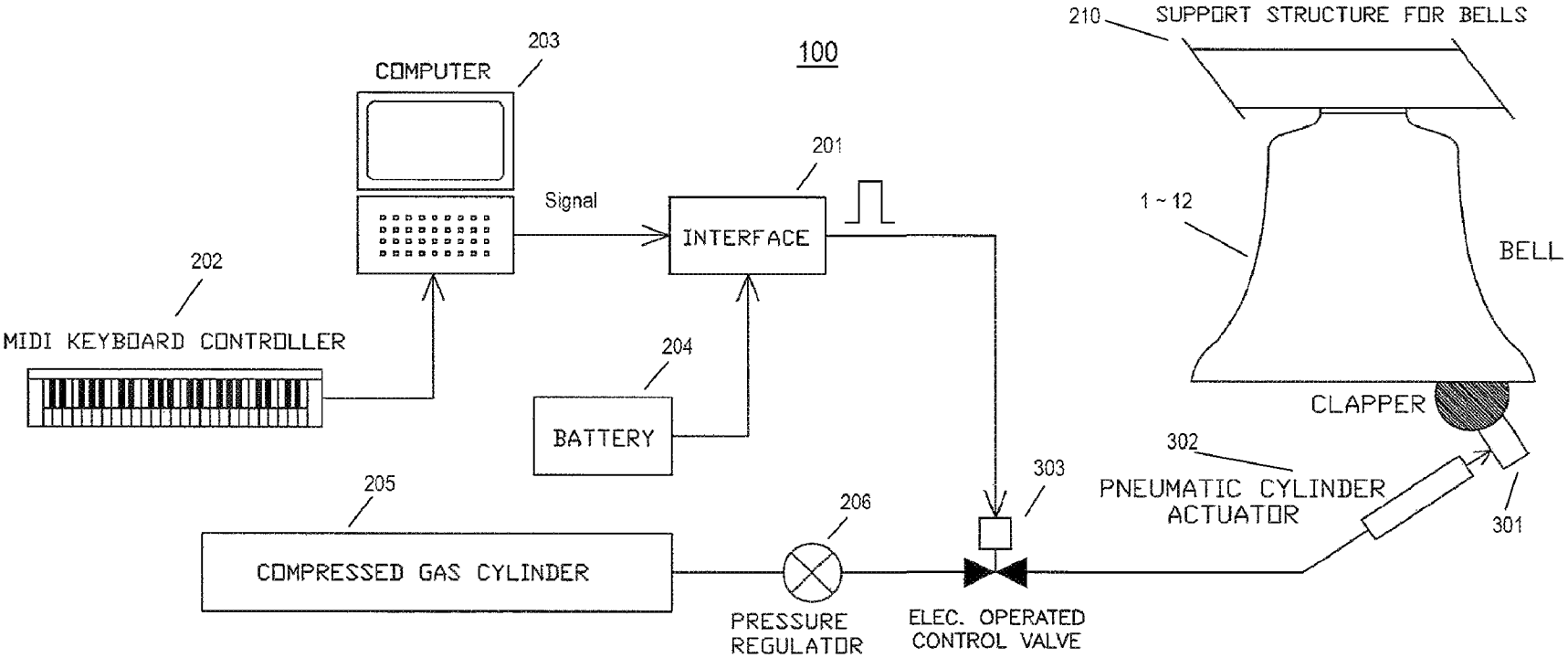
FIG. 6 is a diagram showing one embodiment of a portable bell system.

As shown in FIG. 6, the bell system 100 may include a plurality of control elements, including an interface 201, a keyboard controller 202 and/or a computer 203, and power sources such as a battery 204, compressed gas cylinder 205, pressure regulator 206 that are common for all bells in the portable chime 100. FIG. 6 also shows the structure of one of the bells 1-12 in the portable chime 100, including a clapper 301, a pneumatic cylinder actuator 302, and an electrically operated control valves 303. In a portable bell system 100 that has a bell unit 101 as shown in FIG. 2, there are 12 such bells.

As illustrated in FIG. 6, each bell (1-12) is fitted with an internal clapper 301, so pivoted as to strike the correct internal strike point of the bell when actuated by an associated pneumatic cylinder 302. Each bell is equipped with a pneumatic cylinder 302, so mounted and arranged to operate the clapper 301 of the bell. For each cylinder 302, an electrically-operated valve 303 will be furnished. A suitable interface 201 will be provided to deliver decoded pulses derived from the computer 203 (e.g. a PC type computer) used to control the system, or from the keyboard controller 202 directly. A data stream or signals from the computer 203 pass into the interface 201, which sorts out the data and converts the data to discrete DC pulses to operate pneumatic control valves 303. When a note is played, a low-voltage output from the interface 201 will open the corresponding pneumatic valve 303, operating the associated cylinder 302 and causing the clapper 301 to strike that bell.

Musical selections ("songs") will be stored in the control computer 203 in the form of MIDI files (or in other format)—these may be compiled into a continuous program of selections for a desired period of time, and either manually started, or automatically initiated at a specific time or times. The operation may be controlled by software. In addition to musical selections, the system is capable of performing traditional bell functions, such as time striking (for instance, Westminster quarter chimes and hour strike), wedding peals, and the like, as desired. Further, in addition to automatic playing operations by a computer, it also is possible to connect a compact MIDI keyboard controller 202 to the computer, to permit "live" manual playing of the chime of bells by a musician. A data stream from keyboard controller 202, when music is played upon it, flows to the computer 203 for either storage for later automatic playing, or straight through for a live performance. The MIDI keyboard controller 202 can also be directly connected to a control interface 201 without using a standalone computer 203.

Primary power for striking the bells 1-12 of this portable chime may be furnished by on-board container(s) 205 (e.g. storage cylinder or cylinders) of compressed air, nitrogen, or argon or similar inert gasses. These cylinders 205 are furnished with pressure regulators 206 to step down the storage cylinder pressure to that required to operate the bell-striking pneumatic cylinders 302. Gas (air or other appropriate compressed gaseous medium) flows from a storage cylinder 205, through a pressure regulator 206 (allowing control of playing volume), to electrically operated control valves 303. As DC pulses arrive at the valves 303 from the interface 201, valves 303 open and deliver regulated gas pressure to the pneumatic actuating cylinders 302 at the bells, which in turn physically activate the bell clappers 301, striking the bells and thus creating sound as musical output. Also, the final operating pressure is variable, to allow control of the overall sound volume of the chime as appropriate to different performance venues. External electric power 204 may be provided via power cords, plugs or sockets. Or alternatively, electrical requirements may be furnished by an on-board rechargeable battery or batteries 204, and accordingly, the entire chime playing system is independent of connection with any fixed power source, building or vehicle, and does not require the use of an engine operated compressor or generator, thus insuring quiet operation.

It should be understood, that the invention is not necessarily limited to the specific process, arrangement, materials and components shown and described above, but may be susceptible to numerous variations within the scope of the invention.

What is claimed is:

1. A bell unit of a portable bell system, comprising:
a support structure;
a plurality of bells mounted on the support structure; and
a bell shell including a plurality of segments, at least one of which is displaceable to allow a size change of the bell unit, wherein the bell shell is configured to be
in a first position when the plurality of segments form a shell that is of a shape of a bell, and hangs over and partially encloses the support structure and the plurality of bells, and
in a second position when the at least one segment is displaced to effectuate the size change.

2. The bell unit of claim 1, wherein the bell shell is of a larger size in the first position than in the second position.

3. The bell unit of claim 1, wherein the plurality of segments include first and second half shells, the first half shell being on top of the second half shell when the bell shell is in the first position.

4. The bell unit of claim 1, wherein the plurality of bells includes a set of bells that have pre-determined materials, weights and diameters to produce a plurality of music notes.

5. The bell unit of claim 4, wherein the plurality of music notes is in accordance with the American Standards Association notation.

6. The bell unit of claim 1, wherein the plurality of bells are mounted in a circle on the support structure.

7. The bell unit of claim 1, wherein the plurality of bells are isolated from the support structure.

8. A portable bell system, comprising:
a bell trailer; and
a bell unit mounted on the bell trailer, the bell unit including
a support structure configured to be fixed on the bell trailer,
a plurality of bells mounted on the support structure, and
a bell shell including a plurality of segments, at least one of which is displaceable to allow a size change of the bell unit, wherein the bell shell is configured to be
in a first position when the plurality of segments form a shell that is of a shape of a bell, and hangs over and partially encloses the support structure and the plurality of bells, and
in a second position when the at least one segment is displaced to effectuate the size change.

9. The bell system of claim 8, wherein the bell shell is of a larger size in the first position than in the second position.

10. The bell system of claim 8, wherein the plurality of segments include first and second half shells, the first half shell being on top of the second half shell when the bell shell is in the first position.

11. The bell system of claim 8, wherein the plurality of bells includes a set of bells that have pre-determined materials, weights and diameters to produce a plurality of music notes.

12. The bell system of claim 11, wherein the plurality of music notes is in accordance with the American Standards Association notation.

13. The bell system of claim 8, wherein the plurality of bells are mounted in a circle on the support structure.

14. The bell system of claim 8, further comprising an auxiliary support structure on which, when the bell shell is in the second position, the displaced segment is mountable.

15. The bell system of claim 14, wherein the auxiliary support structure includes a storage compartments.

16. The bell system of claim 8, further comprising a hoist for moving the displaceable segment onto the auxiliary support structure, thereby to change the bell system from the first position to the second position, and for replacing the displaceable segment to restore the bell system to the first position.

17. A portable bell system, comprising:
a bell unit, including
a support structure,
a plurality of bells mounted on the support structure, each bell having
a clapper for ringing the bell,
a pneumatic actuator for activating the clapper, and
a control valve for driving the pneumatic actuator to activate the clapper, and
a bell shell including a plurality of segments configured to form a shell that is of a shape of a bell, and to hang over and partially enclose the support structure and the plurality of bells, at least one of the plurality of segments being displaceable to allow a size change of the bell unit;
a computer for controlling the bell unit;
an interface for converting a control signal from the computer to a DC pulse; and
a pneumatic power source for bell striking; wherein
the control valve, responsive to the DC pulse, controls pneumatic power passing therethrough from the pneumatic power source, to drive the pneumatic actuator of the bell.

18. The portable bell system of claim 17, further comprising a keyboard controller that is connected to the computer for live performance of the bell system.

19. The portable bell system of claim 17, wherein the pneumatic power source includes a compressed gas cylinder and a pressure regulator.

20. The portable bell system of claim 17, further comprising a power source to drive the computer, the interface and the control valve.

* * * * *